US008485154B2

(12) United States Patent
Shibazaki

(10) Patent No.: US 8,485,154 B2
(45) Date of Patent: Jul. 16, 2013

(54) INTAKE MANIFOLD FLANGE

(75) Inventor: Takehiko Shibazaki, Tokyo (JP)

(73) Assignee: Sundance Enterprises Inc., Tokyo (JP)

( * ) Notice: Subject to any disclaimer, the term of this patent is extended or adjusted under 35 U.S.C. 154(b) by 296 days.

(21) Appl. No.: 13/013,621

(22) Filed: Jan. 25, 2011

(65) Prior Publication Data

US 2012/0024254 A1 Feb. 2, 2012

(30) Foreign Application Priority Data

Jul. 27, 2010 (JP) ..... 2010-168578

(51) Int. Cl.
*F02M 35/10* (2006.01)

(52) U.S. Cl.
USPC ..... 123/184.59; 123/184.21; 123/184.61; 403/220

(58) Field of Classification Search
USPC ..... 123/184.21, 184.59, 184.61; 403/220, 403/225, 227
See application file for complete search history.

(56) References Cited

U.S. PATENT DOCUMENTS

| | | | | |
|---|---|---|---|---|
| 5,341,773 | A * | 8/1994 | Schulte et al. | 123/184.61 |
| 5,896,838 | A * | 4/1999 | Pontopiddan et al. | 123/184.47 |
| 6,427,655 | B2 * | 8/2002 | Itoh et al. | 123/184.42 |
| 6,752,113 | B2 * | 6/2004 | Vichinsky | 123/184.21 |
| 6,840,204 | B1 * | 1/2005 | Brassell | 123/184.21 |
| 7,789,066 | B2 * | 9/2010 | Torii et al. | 123/336 |
| 7,837,233 | B2 * | 11/2010 | Johnston et al. | 285/302 |
| 8,171,913 | B2 * | 5/2012 | Sano | 123/337 |

FOREIGN PATENT DOCUMENTS

| | | |
|---|---|---|
| JP | 02-064745 | 5/1990 |
| JP | 2-140418 | 5/1990 |
| JP | 7-197864 | 8/1995 |
| JP | 9-126072 | 5/1997 |
| JP | 9-195870 | 7/1997 |
| JP | 11-107870 | 4/1999 |
| JP | 11-132121 | 5/1999 |
| JP | 2006-342773 | 12/2006 |
| JP | 2008-180129 | 8/2008 |

OTHER PUBLICATIONS

Japanese Application No. 2010-168578 Office Action dated Oct. 11, 2011, 6 pages including English translation.
Shibazaki, Takehiko, "T-SPEC The Apex of V-Twin Engineering", H-D Engine Engineering, vol. 40, Hard Core Chopper Magazine, No. 41, Brain Corporation, Jan. 27, 2010, pp. 64-67.
Japanese Application No. 2010-168578 Office Action dated Mar. 1, 2012, 6 pages including English translation.

* cited by examiner

*Primary Examiner* — Noah Kamen
*Assistant Examiner* — Grant Moubry

(57) ABSTRACT

An intake manifold flange system prevents leakage between joining portions of an intake manifold and a cylinder head while permitting stress relief. A flange body has an opening for receiving a distal end of the intake manifold and fastener hole openings for fixing the flange body to the cylinder head. Spaced annular grooves are arranged in an axial direction of the intake manifold. O-rings of a dimension to extend from the annular grooves and provide a pressurized contact with the distal end of an intake manifold. An annular groove is formed at a surface opposite a mounting portion of the cylinder head and an O-ring seal enables offsetting of the flange body from the cylinder head surface.

8 Claims, 4 Drawing Sheets

INTAKE MANIFOLD FLANGE

CROSS-REFERENCE TO RELATED APPLICATION

This application claims priority from Japanese Patent Application No. 2010-168578 filed on Jul. 27, 2010.

BACKGROUND OF THE INVENTION

1. Field of the Invention

The present invention described herein relates generally to an intake manifold flange that is used for joining an intake manifold and a cylinder head of an internal combustion engine to enable a predetermined sealing movement to accommodate heat and vibration stresses.

2. Description of Related Art

For example, in an internal combustion engine installed on a motorcycle, the air that has been filtered by an air cleaner passes through an intake manifold and is supplied to the cylinder head and interior of the cylinder. The joining portion of the intake manifold and cylinder head is usually jointed by using an intake manifold flange (referred to herein below simply as "flange"). Since the flange is also required to function as an insulator gasket, each gap between the flange and other members is sealed using an elastic seal gasket.

FIG. 3 is a cross-sectional view illustrating the configuration of the seal gasket portion of a conventional flange. As shown in FIG. 3, a flange 2 formed of metal and a seal gasket 40 formed of rubber join and seal an intake manifold 3 and a cylinder head 4.

Thus, an intake port 4*a* is provided in the cylinder head 4, and a distal end of a cylindrical intake manifold 3 is joined to the intake port 4*a*. In this case, the inner diameter of the intake port 4*a* of the cylinder head 4 is equal to the inner diameter of the intake manifold 3 so as not to inhibit the flow of an air-fuel mixture inducted into the cylinder head 4.

The flange 2 is a round disk or elliptical disk shaped member, having in the center thereof an opening 2*a* for inserting the distal end of the intake manifold 3. The inner diameter of the opening 2*a* is somewhat larger than the outer diameter of the intake manifold 3 to enable the aforementioned insertion. The flange 2 has two bolt insertion holes 2*b* in the circumferential edge portion thereof, and the flange 2 and the cylinder head 4 are connected to each other by screwing the distal ends of separately prepared bolts 5 into a wall surface of the cylinder head 4 via the insertion holes 2*b*.

The seal gasket 40 is a ring-shaped member having in the center thereof an opening 40*a* for inserting the distal end of the intake manifold 3. The inner diameter of the opening 40*a* is equal to or somewhat less than the outer diameter of the intake manifold 3. Since the seal gasket 40 is formed from an elastic rubber material, the inner surface of the opening 40*a* and the outer surface of the intake manifold 3 are sealed by the elastic deformation of the seal gasket 40.

In particular, in the conventional configuration, the seal gasket 40 has a prominently triangular cross-sectional shape (wedge shape) with its widest thickness at the intake manifold 4 side. In order to mount the seal gasket 40 of such prominently triangular cross-sectional shape, a taper portion 2*c* expanding toward the cylinder head side is formed at the inner circumference of the flange 2 on the cylinder head 4 side. As a result, when the flange 2 is tightened to the cylinder head 4 by the bolts 5, the seal gasket 40 sandwiched therebetween is pressed against the taper portion 2*c* of the flange 2 and the seal gasket 40 is brought into intimate contact with the surface of the cylinder head 4 and the outer circumferential surface of the intake manifold 3.

Such conventional technique of using the flange and seal gasket is disclosed, for example, in Japanese Patent Application Publication No. H11-132121 and Japanese Patent Application Publication No. 2006-342773.

Generally, when an internal combustion engine operates and is warmed up, the cylinders and cylinder head 4 undergo thermal expansion and contraction. In the running state, in particular in a V-type engine, the expansion and contraction cycles cause changes in the joining distance of the intake manifold positioned in the place sandwiched between two cylinders. As a result, the bolt-tightened cylinder head 4 and the flange 2 slip on the manifold located inside the seal gasket, and move as shown by an arrow in FIG. 3. A similar phenomenon occurs not only when an internal combustion engine is operated, but also when oscillations of the cylinder head 4 are transmitted to the intake manifold 3 during operation of a vehicle or a machine in which an internal combustion engine is installed.

However, in the conventional configuration shown in FIG. 3, since the seal gasket 40 closing the gap between the flange 2 and the intake manifold 3 is strongly tightened by the bolts 5 fixing the flange 2 to the cylinder head 4, whereby the sealing objective is attained, the intake manifold 3 cannot follow the movement of the flange 2 or cylinder head 4.

Therefore, the inner surface of the seal gasket 40 and the outer circumferential surface of the intake manifold 3 rub against each other, or the seal gasket 40 is deformed. As a result, deterioration or wear of the seal gasket 40 occurs, and eventually a gap is formed between the intake manifold 3 and the seal gasket 40, seal performance deteriorates, and secondary air is inducted into the intake manifold 3.

Where the secondary air is inducted from the gap between the intake manifold 3 and the cylinder head 4, the balance of the intake mixture becomes unstable, and when the air-fuel mixture becomes lean and easily flammable, various inconveniences—for example, backfire—increase and operational instability or stalling, can occur. Further, when heat or gasoline is discharged from inside the manifold through the gap in the joining portion, the seal gasket 40 is scorched or becomes swollen.

This phenomenon clearly appears in a V-type engine of a motorcycle such as described in Japanese Patent Application Publication No. 2008-180129. FIG. 4 is a schematic diagram of an engine described in Japanese Patent Application Publication No. 2008-180129. This engine is provided with a first cylinder 23*a* and a second cylinder 23*b* that are arranged in a V-shaped configuration with respect to a crankshaft 22 inside a crankcase 21. A cylinder body 24, a cylinder head 4, and a combustion chamber 30 are provided in each of the cylinders 23*a*, 23*b*, and the combustion chamber 30 is connected to an intake manifold 3 at the entrance to an intake port 4*a*.

In such a V-type two-cylinder engine, when the first and second cylinders 23*a*, 23*b* extend or shrink in the axial direction thereof (A direction in FIG. 4) due to thermal expansion, the distance between the two cylinders changes and a force is applied to the intake manifold 3 in the B direction shown in FIG. 4. As a result, in the configuration in which strong fixing is performed by the flange 2 and the seal gasket 40, as in the related art illustrated in FIG. 3, the action of this thermal expansion cannot be followed and the above-described problems occur.

By contrast, with the technique described in Japanese Patent Application Publication No. H11-132121 and Japanese Patent Application Publication No. 2006-342773, a flange is fixed to the distal end of the intake manifold by welding, integral molding, or casting, and the leak of the secondary air from the gap between the flange and the intake manifold is prevented. However, when the existing intake manifold that has not been integrally molded with a flange is connected to a cylinder head, the manifold of the above-described type cannot be used due to the structure thereof.

In particular, in existing engines for motorcycles, an intake manifold and a flange are often produced separately for improved attachment maintainability, and the structures described in Japanese Patent Application Publication No. H11-132121 and Japanese Patent Application Publication No. 2006-342773 cannot be used. When the related art illustrated in FIG. 3 is used in such a motorcycle, the leak from the connection portion of the intake manifold and cylinder head can not be reliably prevented over a long period.

SUMMARY OF THE INVENTION

The present invention described herein has been created to resolve the above-described problems of the related art, and its objective is to provide a leak-free intake manifold flange that can ensure sealing at the joining surface of an intake manifold and a cylinder head even when cylinders and cylinder heads undergo thermal expansion and contraction caused by operation of an internal combustion engine.

In accordance with the present invention, an intake manifold flange for joining a cylinder head and an intake manifold of an internal combustion engine, including: a flange body made from a metal; and sealing members such as O-rings formed from an elastic material, includes the following features.

(1) The flange body is provided with an opening for inserting a distal end of the intake manifold, and bolt insertion holes for fixing the flange body to the cylinder head.

(2) A plurality of annular grooves arranged with a spacing in the axial direction of the intake manifold are provided in the inner circumferential surface of the opening, and an O-ring is fitted into each of the plurality of annular grooves, to be brought into intimate contact with the outer circumferential surface of the intake manifold.

(3) An annular groove is formed in the flange body at a joining and mounting surface thereof with the cylinder head, so as to surround the outer circumference of the opening provided in the flange body, and an O-ring is fitted into the annular groove to be brought into intimate contact with the surface of the cylinder head.

In accordance with the present invention, the internal combustion engine is a V-type engine in which cylinders are arranged in a V shape, and the flange body and the O-rings join the cylinder head and the intake manifold of each cylinder of the V-type engine.

In accordance with the present invention, a predetermined gap between the flange body and the intake manifold—which are not directly together fixed by any means; for example, by bolt tightening—is sealed by a plurality of O-rings disposed with a spacing in the axial direction of the intake manifold. As a result, air tightness and mobility in this portion can be ensured by the plurality of O-rings even when the cylinder head thermally expands or vibrates due to the operation of the internal combustion engine, and a stress is applied between the flange body and the intake manifold. As a result, even when an internal combustion engine operates over a long period of time, no air leakage occurs from the joining portion of the intake manifold and the cylinder head.

An air intake manifold flange system for joining an opening in the cylinder head with an opening in the intake manifold includes a flange body having a first surface of a configuration to attach to a mounting surface extending around the opening in the cylinder head. A flange opening of a configuration to attach around a distal hollow connecting portion of an intake manifold is provided. The flange opening extends away from the first surface with sufficient depth to support the hollow connecting portion and to provide an opening that is larger than the opening in the cylinder head.

A first annular groove is formed in the first surface to surround the opening in the cylinder head when appropriately mounted. A plurality of spaced second annular grooves are formed along an axis of the flange opening. Sealing members of an elastic material are positioned within the first annular groove and the plurality of second annular grooves and have a dimension to project outward from the respective first annular groove and plurality of the second annular grooves.

The sealing members can sealingly contact, in a flexible manner, the mounting surface of the cylinder head and also the hollow connecting portion of the intake manifold to thereby enable relative movement between the flange body and to further offset the flange body from direct contact with the cylinder head and the intake manifold.

The flange body has a second surface with fastening openings to enable fasteners such as bolts to adjustably be mounted to fix the flange body to the cylinder head at a predetermined pressure force between the respective sealing member in the first annular groove to seal while permitting relative movement of the flange body.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

Reference will now be made in detail to the preferred embodiments of the invention which set forth the best modes contemplated to carry out the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

An embodiment according to the present invention will be described below with reference to FIGS. 1 and 2. Components like those in the related art will be assigned with like reference symbols and explanation thereof will be omitted.

Configuration of the Embodiment

In the present embodiment, a flange 1 has a body 20 formed from a metal such as aluminum, and manifold O-rings 31 and 32 and a cylinder head O-ring 33 formed from a rubber material having pressure resistance and heat resistance, for example, a Teflon® rubber. Further, in the present embodiment, the flange body 20 is formed from aluminum and the O-rings are formed from Teflon rubber and lubricating grease G, but the present invention is not limited to these materials, and other appropriate materials may be also used.

Figure 1:
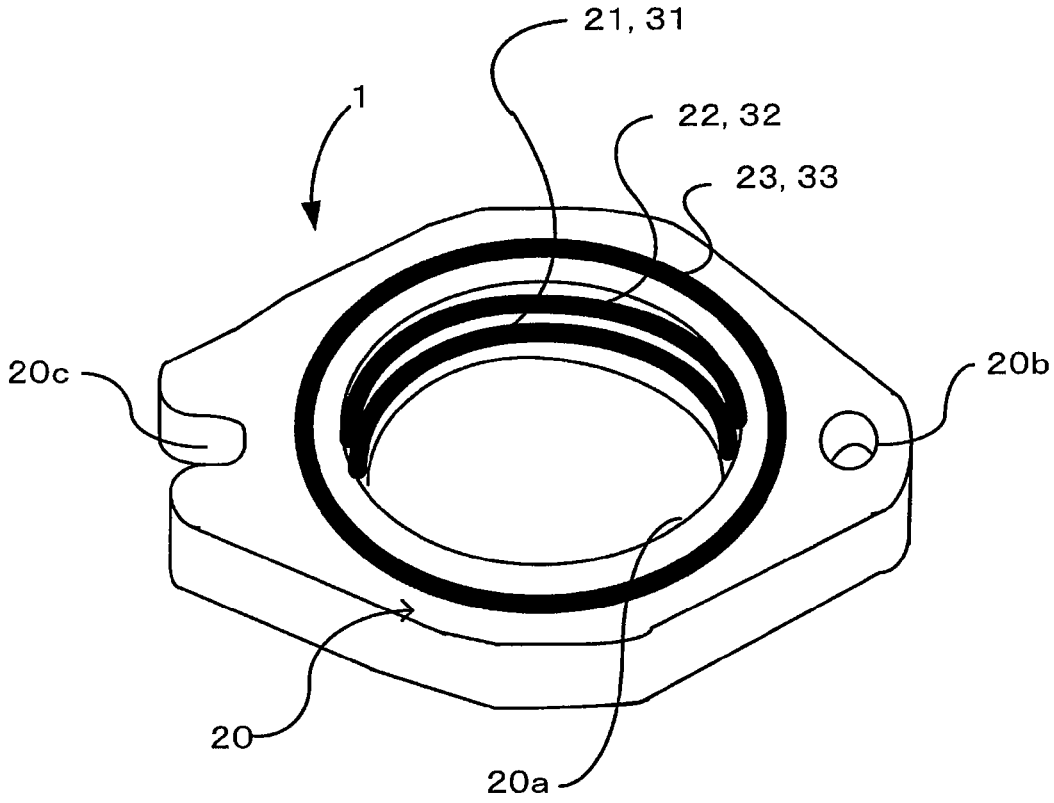
FIG. 1 is a perspective view of a flange according to an embodiment of the present invention.

As shown in FIG. 1, the flange body 20 is provided with an opening 20*a* for inserting a distal end of an intake manifold 3 and bolt insertion holes 20*b*, 20*c* for fixing the flange body 20 to a cylinder head 4. A plurality of annular grooves 21, 22 arranged with a spacing in the axial direction of the intake manifold 3 are provided in the inner circumferential surface of the opening 20*a*. The O-rings 31, 32 that are brought into intimate contact with the outer circumferential surface of the intake manifold 3 are fitted into the plurality of annular grooves 21, 22, respectively. For this purpose, the grooves 21, 22 have a semicircular or quadrilateral cross-sectional shape having a depth such that portions of the O-rings 31, 32 protrude from the surface of the grooves 21, 22 to the surface side of the intake manifold 3 to provide a predetermined sealing pressure while permitting movement to accommodate stresses.

Further, an annular groove 23 is formed in the flange body 20 at the joining surface thereof with the cylinder head 4, so as to surround the outer circumference of the opening 20*a* provided in the flange body. An O-ring 33 that is brought into intimate contact with the surface of the cylinder head 4 is fitted into the annular groove 23. The depth and shape of the annular groove 23 are such that a portion of the O-ring 33 fitted into the annular groove protrudes from the edge of the groove 23 to the cylinder head 4 side to provide a predetermined sealing pressure while permitting movement to accommodate stresses. The respective sealing members of the O-rings 31, 32 and 33 offset the flange body 20 from direct contact with the cylinder head and the hollow extension of the intake manifold.

Operation of the Embodiment

A method for sealing the intake manifold 3 and the cylinder head 4 with the flange of the present embodiment having the above-described configuration will be described below. As shown in FIG. 2, the O-rings 31, 32 are fitted in the two annular grooves 21, 22 formed in the inner surface of the opening 20*a* of the flange body 20, and in this state the distal end of the intake manifold 3 is inserted into the opening 20*a*. In this case, the portions of the O-rings 31, 32 protruding from the edge of the annular grooves 21, 22 are compressed and deformed between the flange body and the outer circumferential surface of the intake manifold 3, and the resultant elastic deformation seals a gap between the inner surface of the opening 20*a* and the outer circumferential surface of the intake manifold 3.

In this state, the distal end of the intake manifold 3 and a portion of the intake port 4*a* of the cylinder head 4 are aligned while pressing the flange body 20 in which the O-ring 33 is fitted in the annular groove 23 against the surface of the cylinder head 4. Then, the flange body 20 is fixed to the surface of the cylinder head 4 by fasteners such as the bolts 5 inserted into the bolt insertion holes 20*b*, 20*c* of the flange body. In this case, when the bolts 5 are tightened, a portion of the O-ring 33 protruding from the edge of the annular groove 23 is deformed by the tightening pressure, and the gap between the cylinder head 4 and the flange body 20 is sealed by the elasticity of the ring.

Figure 2:
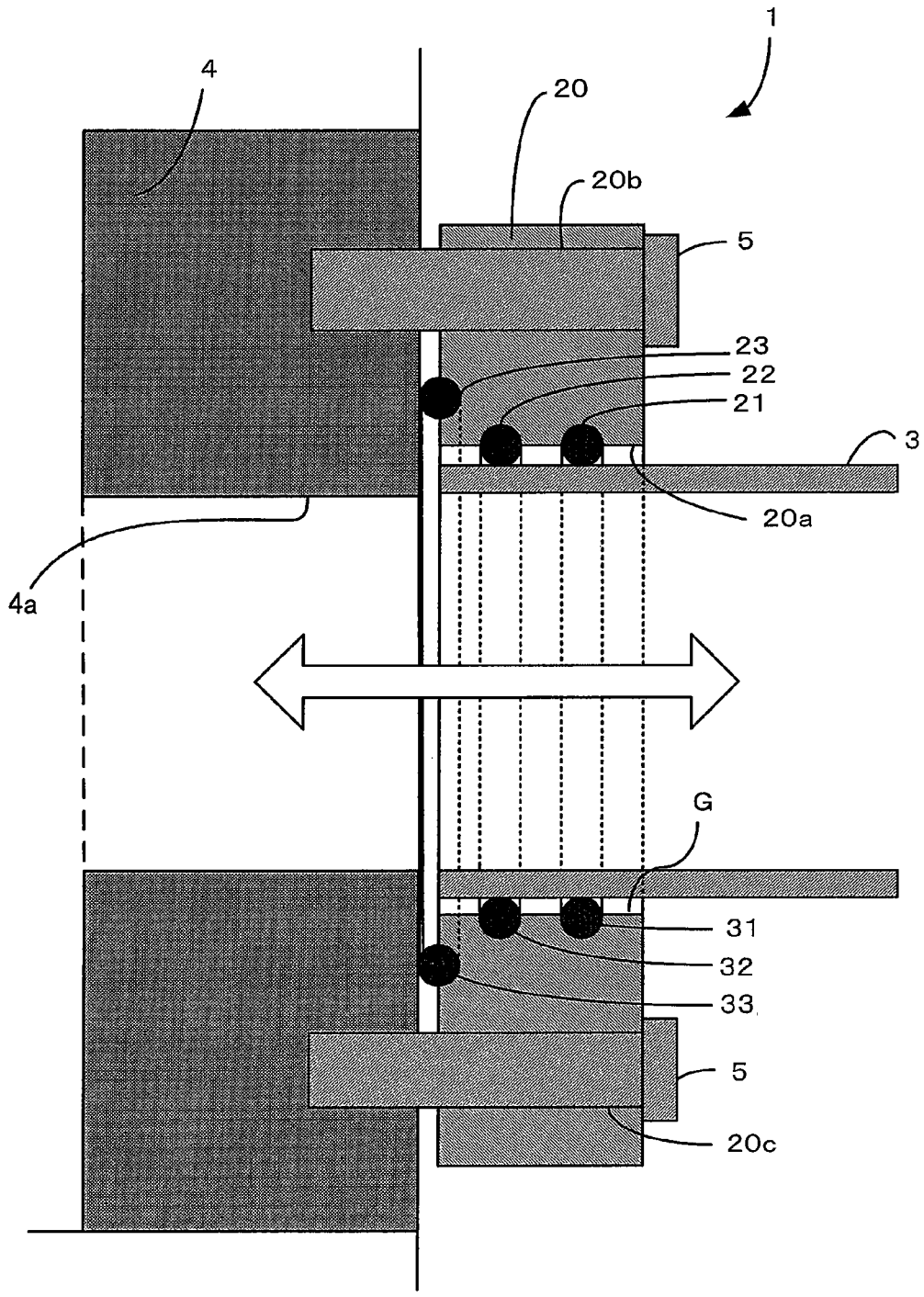
FIG. 2 is a cross-sectional view illustrating the configuration of the seal portion of the flange according to the embodiment of the present invention.
Figure 3:
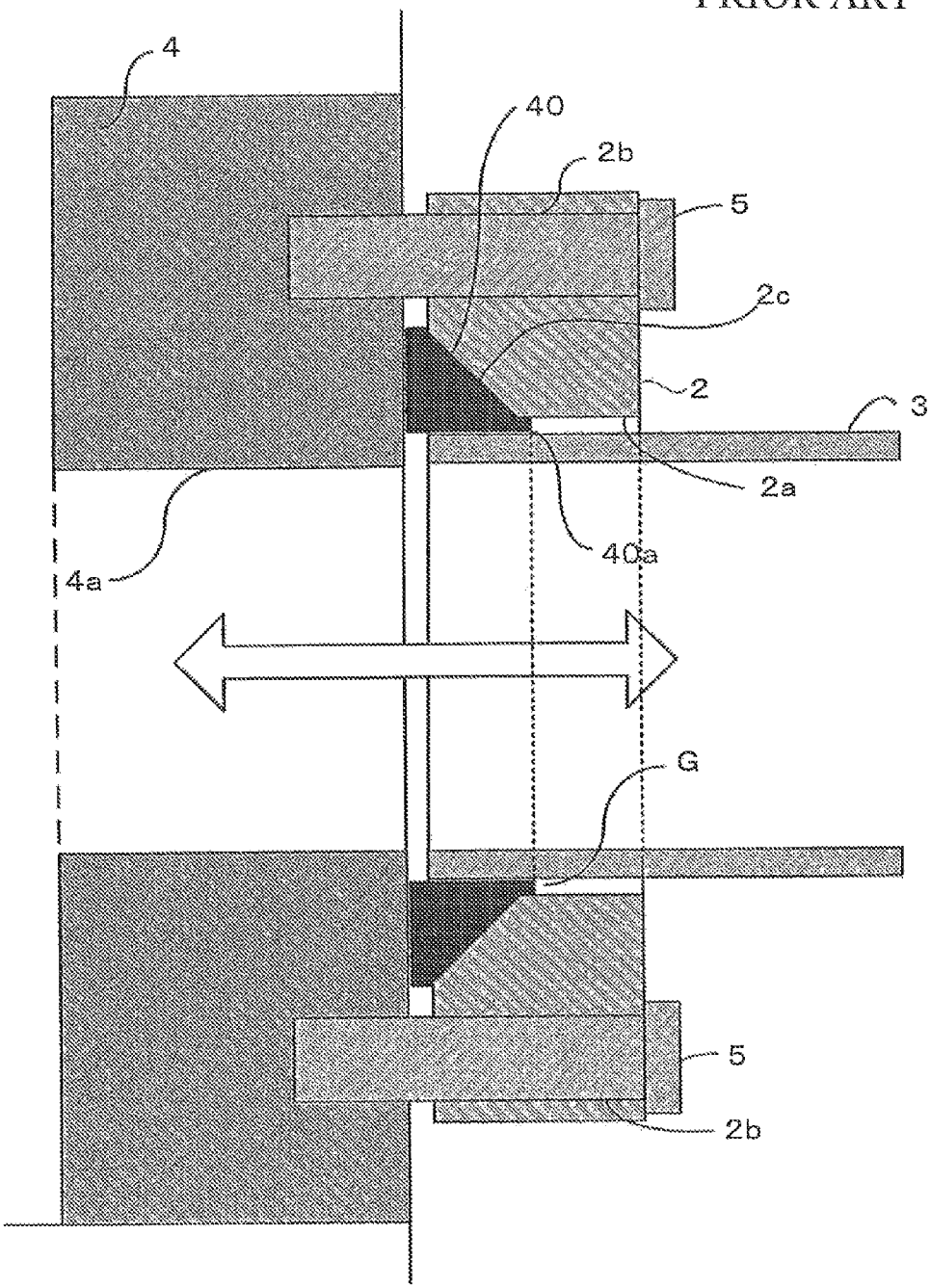
FIG. 3 PRIOR ART
FIG. 3 is a cross-sectional view illustrating the configuration of the seal portion of a conventional flange.

When an internal combustion engine operates and the cylinder head 4 thermally expands or contracts in such a state in which the intake manifold 3 is joined to the cylinder head 4, the cylinder head 4 and the flange body 20 that is tightened by bolts thereto move as shown by arrows in FIG. 2 as a result of such cyclic deformations. On the contrary, the intake manifold 3 that is not tightened by bolts to the flange body 20 cannot follow this motion, but the manifold O-rings 31, 32 are deformed and absorb the amount of movement of the cylinder head 4 and the intake manifold 3. Further, when the movement cannot be fully absorbed only by the deformation of the O rings, a larger movement amount can be absorbed by the slippage of the O-rings 31, 32 and the cylinder head 3.

Effect of the Embodiment

In the present embodiment, the gap between the flange body and intake manifold is double sealed by two O-rings 31, 32 disposed with a certain spacing, and therefore excellent air tightness is ensured. At the same time, the flange body 20 and the intake manifold 3 are movably supported by the elastic O-rings. As a result, a stress applied between the cylinder head 4 and the intake manifold 3 by the thermal expansion or contraction of the cylinder can be absorbed.

In particular, in the present embodiment, because two O-rings 31, 32 are provided, stresses applied to the O-rings are dispersed and the endurance of each O-ring is increased. Further, the gap at the joining surface of the cylinder head 4 and the flange body 20 is sealed by the O-ring 33. Thus, with the present embodiment, since separate O-rings are provided for each gap, stresses applied to each O-ring are reduced by comparison with those in the case in which two gaps—namely between the cylinder head 4 and the flange 1, and between the flange 1 and the intake manifold 3—are simultaneously sealed by a single seal gasket, as in the conventional configuration. Accordingly, durability for long-term use is improved.

Figure 4:
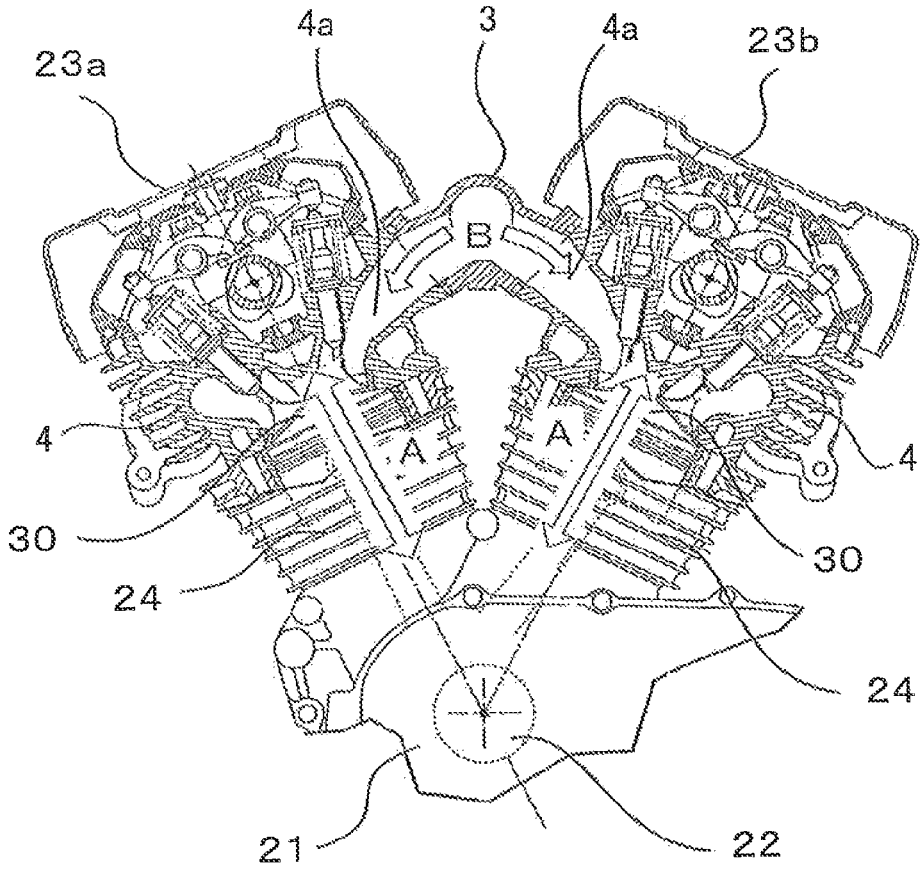
FIG. 4 PRIOR ART
FIG. 4 is a cross-sectional view illustrating a state of thermal expansion in a V-type two-cylinder engine.

Further, such a configuration using manifold O-rings 31, 32 is particularly useful in the case of a V-type two-cylinder engine such as shown in FIG. 4. Thus, even when the distance between the intake ports 4*a*, 4*a* of cylinders 23*a*, 23*b* is changed due to thermal expansion or contraction of the cylinders in the V-type two-cylinder engine, the combination of two O-rings 31, 32 at the intake manifold 3 side, or the combination that further includes the lubricating grease G and/or the O-ring 33 for the cylinder head, allows it to effectively absorb this change in the distance and maintain good seal performance between the cylinder head 4 and the intake manifold 3.

Other Embodiments

In the embodiment illustrated by the figures, a plurality of bolt insertion holes 20*b*, 20*c* are provided to fix the flange body 20 to the cylinder head 4. One of them is a round through hole 20*b* and the other is a U-shaped cut hole 20*c* open at one end. Such configuration is selected to obtain an allowance when the bolts 5 are inserted, but not limited to, and the two bolt insertion holes 20*b*, 20*c* may have the same shape.

The flange 1 of the embodiment illustrated by the figures uses a plurality of manifold O-rings 31, 32 and the manifold O-ring 33, but not limited to, and for example a larger number of O-rings may be used.

Further, the present invention can be broadly used when intake manifolds are joined to intake ports of various internal combustion engines other than V-type two-cylinder engines of motorcycles.

Those skilled in the art will appreciate that various adaptations and modifications of the just-described preferred embodiment can be configured without departing from the scope and spirit of the invention. Therefore, it is to be understood that, within the scope of the amended claims, the invention may be practiced other than as specifically described herein.

What is claimed is:

1. An intake manifold flange for joining a cylinder head and an intake manifold of an internal combustion engine, the cylinder head and the intake manifold changing their relative position to each other due to thermal expansion and contraction, respectively caused by an operation and a stop of an internal combustion engine, the intake manifold flange comprising:

a flange body made from a metal; and

O-rings formed from an elastic material, wherein the flange body is provided with an opening for inserting a distal end of the intake manifold and bolt insertion holes for fixing the flange body to the cylinder head, the intake manifold being axially movably when inserted into the opening;

a plurality of annular grooves, arranged with a spacing along the axial direction of the intake manifold, are provided in an inner circumferential surface of the opening of the flange body, and an outer circumference of at least one of the O-rings is fitted at the inner circumference thereof into each of the plurality of annular grooves;

the outer circumference of the intake manifold has an annular portion with which an inner circumference of at least one of the O-rings is brought into an elastic intimate contact at the outer circumference surface thereof;

an annular groove is formed in the flange body at the joining surface thereof with the cylinder head, so as to surround the outer circumference of the opening provided in the flange body, and one of the O-rings that is brought into intimate contact with the surface of the cylinder head is fitted into this annular groove;

the flange body and the intake manifold are provided with lubricating grease between the inner circumference of the flange body and the outer circumference of the intake manifold, the lubricating grease allowing slippage between the O-rings and the intake manifold; and the flange body allows the axial movement of the intake manifold relative to the flange body by deformation of the O-rings and the slippage between the O-rings and the intake manifold due to the lubricating grease when the cylinder head is fixed with, a bolt to the flange body.

2. The intake manifold flange according to claim 1, wherein the internal combustion engine is a V-type engine in which cylinders thereof are arranged in a V shape, and the flange body and the O-rings join the cylinder head and the intake manifold of each cylinder of the V-type engine.

3. A resilient intake manifold flange system for joining an opening in a cylinder head with an opening in an intake manifold, comprising:

a flange body having a first surface of a configuration to attach to a mounting surface extending around the opening in the cylinder head and a flange opening of a configuration to attach around a hollow connection portion of an intake manifold and extend away from the first surface, the flange opening is larger than the opening in the cylinder head and of a depth to support the hollow connection portion, wherein the hollow connection portion of the intake manifold is axially movable within the flange opening due to thermal expansion and contraction during operation of the cylinder head;

a first annular groove is formed in the first surface to surround the opening of the cylinder head;

a plurality of second annular grooves are formed in the flange opening; and sealing members of an elastic material are positioned, within the first annular groove and the plurality of second annular grooves, of a dimension to project outward from the respective first annular groove and the plurality of second annular grooves, wherein the sealing members contact in a flexible manner the mounting surface of the cylinder head and the hollow connecting portion of the intake manifold to maintain sealing contact while also enabling relative movement to the intake manifold within the grip of the plurality of inner circumferential flange body sealing members.

4. The resilient intake manifold flange system of claim 3 wherein the sealing members are heat resistant and a lubricating grease is provided between the sealing members to enable slippage between the sealing members and the hollow connection portion of the intake manifold.

5. The resilient intake manifold flange system of claim 4 wherein the flange body is mounted on the cylinder head with a gap opening between the flange body and the cylinder head and the hollow connection portion of the intake manifold is mounted in the flange opening with a gap opening between the flange body and the hollow connection portion.

6. In an intake manifold flange for joining a cylinder head and an intake manifold of an internal combustion engine, the improvement of the intake manifold flange comprising:

a flange body formed from a metal with an opening therein configured to permit relative movement of a hollow connection conduit on the intake manifold and an intake port entrance on the internal combustion engine, the flange body having a plurality of annular grooves offset from each other along an inner surface of the opening, the inner surface of the opening is larger than an outer surface of the hollow connection conduit of the intake manifold; and an O-ring formed from an elastic material is mounted in each of the plurality of the annular grooves and configured to enable a sealing of the outer surface of the hollow connection conduit of the intake manifold while permitting a relative movement of the intake manifold and cylinder head, during operation of the internal combustion engine.

7. The intake manifold flange according to claim 6, further including lubricating grease positioned between the inner surface of the opening in the flange body and the outer surface of the hollow connection conduit of the intake manifold to facilitate relative movement.

8. The intake manifold flange according to claim 6, wherein the flange body has a joining surface, surrounding the opening, spaced from the cylinder head, the joining surface has an annular groove offset from the opening and configured to receive a larger diameter O-ring than the plurality of O-rings mounted in the plurality of annular grooves on the inner surface of the opening in the flange body, wherein the configuration of the larger O-ring in the offset annular groove provides a predetermined sealing pressure to prevent external release of fluid from the intake manifold, while the securement of the flange body with a gap between the cylinder head and the intake manifold permits a relative movement of the cylinder head and intake manifold.

* * * * *